US008996209B2

(12) United States Patent
Temming

(10) Patent No.: US 8,996,209 B2
(45) Date of Patent: Mar. 31, 2015

(54) METHOD FOR OPERATING A RAILWAY SECTION AND CORRESPONDING RAILWAY SECTION

(75) Inventor: Rudolf Temming, Koenigslutter (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/116,246

(22) PCT Filed: May 7, 2012

(86) PCT No.: PCT/EP2012/058357

§ 371 (c)(1), (2), (4) Date: Nov. 7, 2013

(87) PCT Pub. No.: WO2012/152748

PCT Pub. Date: Nov. 15, 2012

(65) Prior Publication Data

US 2014/0107874 A1 Apr. 17, 2014

(30) Foreign Application Priority Data

May 11, 2011 (DE) ..... 10 2011 075 652

(51) Int. Cl.
*G06F 17/00* (2006.01)
*B61L 7/00* (2006.01)
(Continued)

(52) U.S. Cl.
CPC . *B61L 7/00* (2013.01); *B61L 1/169* (2013.01); *B61L 5/1881* (2013.01); *B61L 7/08* (2013.01); *B61L 27/0088* (2013.01)
USPC ..... 701/19; 246/162; 246/176; 246/220

(58) Field of Classification Search
CPC ..... B61L 17/00; B61L 1/181; B61L 23/044; B61L 11/08; B61L 1/169
USPC ..... 701/19; 246/162, 176, 220; 324/713
See application file for complete search history.

(56) References Cited

U.S. PATENT DOCUMENTS 4,611,291 A * 9/1986 Hoelscher ..... 702/57
5,491,788 A * 2/1996 Cepulis et al. ..... 714/13
(Continued)

FOREIGN PATENT DOCUMENTS

DE 102008033712 A1 1/2010
DE 102010010452 A1 9/2011
(Continued)

OTHER PUBLICATIONS

Verma, A Fail-Safe Interlocking System for Railways, 1991, IEEE, p. 58-66.*
(Continued)

*Primary Examiner* — McDieunel Marc
(74) *Attorney, Agent, or Firm* — Laurence A. Greenberg; Werner H. Stemer; Ralph E. Locher

(57) ABSTRACT

A method for operating a railway section that includes section elements, which are each actuated by a processor that is reliable in terms of signaling and cyclically carries out a test routine. A railway section is configured for carrying out the method. In order to save energy and cost, the processor is operated selectively in active mode or sleep mode. From the sleep mode the processor is switched to the active mode for the duration of the test routine by way of a timer logic element that is reliable in terms of signaling.

3 Claims, 1 Drawing Sheet

(51) Int. Cl.

| | |
|---|---|
| ***B61L 1/16*** | (2006.01) |
| ***B61L 5/18*** | (2006.01) |
| ***B61L 7/08*** | (2006.01) |
| ***B61L 27/00*** | (2006.01) |

(56) References Cited

U.S. PATENT DOCUMENTS

| | | | | |
|---|---|---|---|---|
| 6,457,682 | B2 | 10/2002 | Anderson et al. | |
| 7,268,565 | B2 * | 9/2007 | Anderson | 324/713 |
| 7,416,159 | B2 * | 8/2008 | Beaman et al. | 246/219 |
| 7,457,691 | B2 * | 11/2008 | Muinonen et al. | 701/19 |
| 7,742,849 | B2 * | 6/2010 | Muinonen et al. | 701/19 |
| 7,831,342 | B2 * | 11/2010 | Muinonen et al. | 701/19 |
| 8,469,319 | B2 | 6/2013 | Kiss, Jr. et al. | |
| 8,540,192 | B2 | 9/2013 | Basso et al. | |
| 2007/0132463 | A1 * | 6/2007 | Anderson | 324/713 |
| 2009/0259353 | A1 * | 10/2009 | Muinonen et al. | 701/19 |
| 2010/0127134 | A1 * | 5/2010 | Ruskauff et al. | 246/220 |
| 2012/0004796 | A1 * | 1/2012 | Michaut | 701/19 |

FOREIGN PATENT DOCUMENTS

| | | | |
|---|---|---|---|
| EP | 1594101 | A1 | 11/2005 |
| EP | 1731397 | A1 | 12/2006 |
| EP | 2162339 | B1 | 7/2013 |
| WO | 2009100292 | A1 | 8/2009 |
| WO | 2010006926 | A1 | 1/2010 |
| WO | 2011107362 | A1 | 9/2011 |

OTHER PUBLICATIONS

Rusu et al., Improvement of electric railway transportation protection systems using a relay based on fuzzy logic, 2011, IEEE, p. 1-4.*

* cited by examiner

METHOD FOR OPERATING A RAILWAY SECTION AND CORRESPONDING RAILWAY SECTION

BACKGROUND OF THE INVENTION

Field of the Invention

The invention relates to a method for operating a railway section with section elements, for example signals, switches, and track vacancy detection devices, which are each activated by a processor that is safe in respect of signaling technology which cyclically executes a test routine, and also to a railway section for carrying out the method.

Section elements are understood to be all facilities which are used in the track systems area for the safety and control of rail traffic. These may involve, for example, axle counters, switch drives, signals or track breakage detectors. Usually the section elements and the processors that activate them have power supplied to them permanently, so that they are ready to operate at all times and it is possible to carry out test routines. Axle counters and switch contacts are permanently supplied with a no-load current for example and processors that are safe in respect of signaling, for example in the form of electronic setting units, are switched on all the time. This consumes a great deal of energy.

The requirements for signaling safety are defined in CENELEC Standard EN50129,from SIL0—not safe in respect of signaling—to SIL4—highly safe in respect of signaling. Processors that are safe in respect of signaling, according to SIL3 and SIL4 are generally embodied as multichannel processors and carry out test routines cyclically within a defined period of time during the startup phase and after startup. If the cyclic checking is not performed successfully within the defined period of time, safety-relevant operation is no longer possible and as a rule a safety-relevant switch-off is performed. The cyclic checking is carried out in the time windows in which the safe processor does not have to carry out any logic for normal operation.

Since the test routines make the startup times very long, for example appr. 30 s, the processor remains permanently switched on for safety's sake, through which the activated section elements also remain switched on and a high power demand results.

BREIF SUMMARY OF THE INVENTION

The underlying object of the invention is to specify a generic method for operating a railway section, as well as a railway section suitable for carrying out the method, which make it possible to reduce the power consumption.

As regards the method the object is achieved by the processor being operated depending on demand in active mode or in sleep mode, wherein the processor in sleep mode is switched into active mode for the duration of the test routine by means of a timer logic that is safe in respect of signaling technology.

The object is also achieved by a railway section for carrying out the method in which the processor is embodied as able to be operated depending on demand in active mode and sleep mode and is switchable during sleep mode into active mode for the duration of the test routine by means of a timer logic that is safe in respect of signaling technology.

The fact that the section elements are very largely operated in a low-load state in the sleep mode of the activating processor results in a significant saving in energy and thus in costs. Low-load state can in such cases mean energy-saving mode as a type of standby operation or even a completely no-load state, i.e. switched-off state. Full-load state, i.e. fully functional operating state of the section element, is only provided when actually required, namely only when a rail vehicle needs the respective section element. In this way for example signals can be activated by the processor that is safe in respect of signaling technology such that power is only supplied in the area of visibility of the approaching rail vehicle and the signal, as soon as the visibility area is left, is switched to dark by the processor.

Since a true processor start-up time is dispensed with and the processor almost only has to be switched on and is already in the tested state in sleep mode on account of the test routine, it can be ensured that the processor is immediately ready for use after a switch-on request. Only a period of approximately 30 ms is needed for the switching on of the processor, while starting up a processor requires approximately 30 s. The processor that is safe in respect of signaling technology is in the tested state both in active mode and also in sleep mode. In active mode the cyclic testing is undertaken as previously during the time window in which the safe processor does not have to carry out any logic for normal operation. In sleep mode the processor is switched back into active mode by the timer logic that is safe in respect of signaling technology in good time, so that it can execute the cyclic tests even before the defined period of time elapses. The timer logic is preferably embodied as three-channel logic at the SIL4 safety level.

By restricting the periods in which the processor and the activated section elements are ready to operate to the periods actually required, a significant saving in energy can be produced, especially for lightly-used sections of line or branch lines.

The ready-to-operate state can be established in such cases at any time by a track vacancy detection signal for example. With available track vacancy systems, based on axle counters for example, their very safely created output signal can in this way be almost used other than for its intended purpose or used jointly.

In accordance with the claimed invention there is provision for the section elements to be connected to devices for local power supply. In this way, as well as energy savings, a good starting point for future wireless concepts of railway safety technology is produced. Decentralized, i.e. local supply of energy to section elements, for example by means of battery or solar panel, also enables section elements at remote locations to be operated entirely independently of fixed lines or radio channels with fixed assignments.

The invention is explained below with reference to diagrams in figures.

DESCRIPTION OF THE INVENTION

Figure 1:
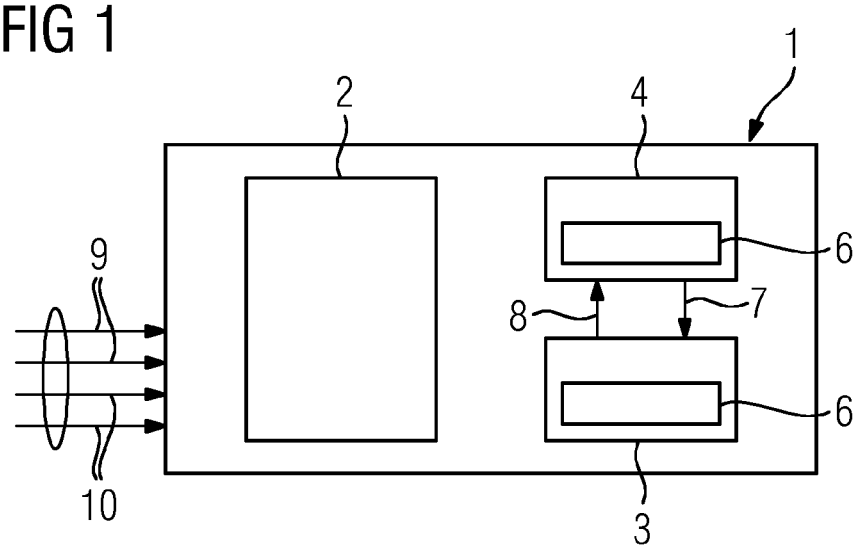
FIG. 1 shows the major modules of a processor that is safe in respect of signaling technology and FIG. 2 shows a multichannel processor architecture.

The processor 1 that is safe in respect of signaling technology depicted in FIG. 1 essentially consists of function blocks for the actual processor functionality 2, an active mode 3 and a sleep mode 4. The active mode 3 contains logic for cyclic execution of a test routine 5, through which safety requirements for an SIL3 or SIL0 status of the processor 1 are fulfilled. So that this test routine 5 can also be executed during sleep mode 4, timer logic 6 is provided in sleep mode 4, which switches over 7 the processor 1 into the active mode 3 for executing the cyclic test routine 5. After the ending of the test routine 5, the processor 1 is switched back B into the sleep mode 4. In this way the processor 1 is permanently, i.e. even during the sleep mode 4, in the tested state and can, on request, switch its actual processor functionality 2, namely the activation of assigned section elements, immediately from sleep mode 4 into active mode 3. The processor functionality 2 is requested in such cases by a demand-dependent signal from outside, for example by an activated communication signal 9 or by a supervisor signal 10. Because of the timer logic 6 which starts the test routine 5 in sleep mode 4, there is no actual processor startup in which the test routine 5 would have to be executed and which would therefore cause an impermissibly long period during which functions of the processor 1 are unavailable. Instead, for demand-dependent switchover from sleep mode 4 into active mode 3, the processor 1 almost merely has to be woken up.

Figure 2:
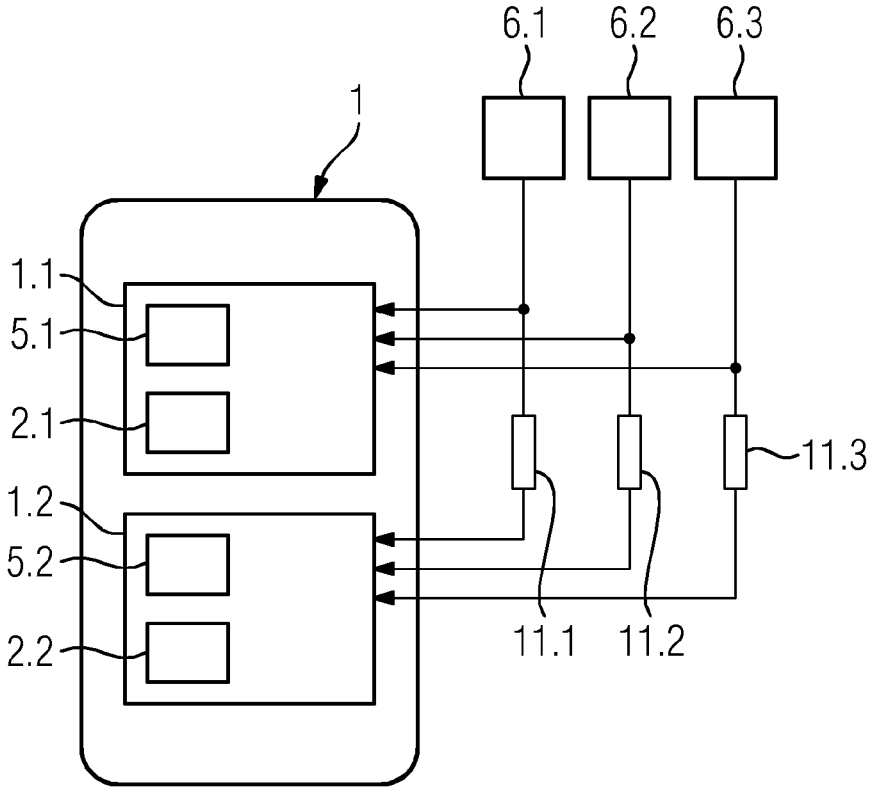

FIG. 2 shows a two-channel processor architecture in conjunction with a three-channel timer logic. Each of the three functionally-identical timer channels 6.1, 6.2 and 6.3 is connected in this case to the first 1.1 and the second processor channel 1.2. The processor channels 1.1 and 1.2 in such cases execute the test routine 5.1 and 5.2 and the demand-dependent processor functionality 2.1 and 2.2 independently of one another. For unique channel separation resistors 11.1, 11.2 and 11.3 are connected upstream from the second processor channel 1.2.

Only the processor architecture presented in FIGS. 1 and 2 guarantees sufficient safety in respect of signaling technology to introduce a sleep mode 4 and thus to significantly reduce the energy requirement of the processor 1 and of the section elements under its control. Ultimately this also produces the possibility of a decentralization, in particular as regards the supply of power, which can for example be based on solar power.

The invention claimed is:

1. A method of operating a railway section, the railway section having section elements, including signal devices, switches and track vacancy detection devices, each activated by a processor that is safe in respect of signaling technology, the method comprising:

selectively operating the processor in active mode or in sleep mode;

cyclically executing a test routine that tests the processor and, for the duration of the test routine, switching the processor from sleep mode into active mode by a timer logic that is safe in respect of signaling technology.

2. A railway section for carrying out the method as claimed in claim 1, which comprises:

a processor configured for selective operation in active mode and in sleep mode, as required, and a timer logic that is safe in respect of signaling technology and is configured to switch said processor from the sleep mode into active mode for the duration of the test routine.

3. The railway section according to claim 2, which further comprises devices for decentralized power supply connected to said section elements.

* * * * *